US007267052B1

(12) United States Patent
Streng

(10) Patent No.: US 7,267,052 B1
(45) Date of Patent: Sep. 11, 2007

(54) PORTABLE CAN CRUSHING AND PICKUP DEVICE

(76) Inventor: Michael Howard Streng, 10325 State Route 736, Plain City, OH (US) 43064

( * ) Notice: Subject to any disclaimer, the term of this patent is extended or adjusted under 35 U.S.C. 154(b) by 0 days.

(21) Appl. No.: 11/510,977

(22) Filed: Aug. 28, 2006

(51) Int. Cl.
*B30B 9/32* (2006.01)
*B30B 15/06* (2006.01)

(52) U.S. Cl. ..... 100/265; 100/218; 100/230; 100/245; 100/902; 241/169

(58) Field of Classification Search ..... 100/214, 100/218, 226, 229 R, 229 A, 230, 240, 245, 100/265, 902; 241/169; 294/19.1, 19.2; 30/120.2, 120.5; 99/572, 580, 582
See application file for complete search history.

(56) References Cited

U.S. PATENT DOCUMENTS 2,609,198 A * 9/1952 Armstrong ..... 473/133
4,417,512 A * 11/1983 Engelke ..... 100/266
4,570,536 A * 2/1986 Dodd ..... 100/345
6,684,762 B1 * 2/2004 Schwelling ..... 100/41
2005/0181886 A1 * 8/2005 Zmetra ..... 473/286

* cited by examiner

*Primary Examiner*—Jimmy Nguyen

(57) ABSTRACT

A combination can crushing and retrieving device having a circular or tubular housing containing a plunger and having a rectangular opening in its side wall. The housing has a knife-edged slightly concave indent on the bottom of the housing opposite the rectangular opening, which indent generally conforms to the arch section of the necked down portion of a beverage can. When the concave indent is placed on the lip of a can laying on its side and forced down the can will "snap" upright, through the rectangular opening and into the housing. The can is then retained in the housing around the necked down portion by a foam/rubber lining located at the lower inside end of the housing. Then the weighted plunger is forced down onto the can, crushing the can and expelling any fluids remaining inside the can through the drinking opening. The can may then be ejected from the device by pressing an ejector rod.

1 Claim, 7 Drawing Sheets

| # | Description of Part | Manufacturer | Retailer |
|---|---|---|---|
| | ***Shell parts (1-6)*** | | |
| 1 | 5/16 thick x 19/32 wide cellular rubber, self adhesive weather seal | MD Bldg. Products | Lowes |
| 2 | 3" CP PVC Plumbing & Sewer pipe schedule 20 ASTM 2729 | Genova | Anderson |
| 2a | 3" CP PVC pipe schedule 40 ASTM | | Lowes |
| 3 | 3 " to 1 1/2 reducer thin wall PVC - TIGI 60131ASTM 2949 | Genova | Lowes |
| 4 | 1 1/2" to 11/4" bushing schedule 40 (modified) | Lasco | Lowes |
| 5 | 1 1/4" PVC 1120 SDR-26 PR 160 PSI | Silverline | Lowes |
| 6 | 1 1/4" cap sch 40 | Lasco | Lowes |
| | ***Weight & Ramrod parts (7-10)*** | | |
| 7 | 3/4 " x 1 3/8" nipple (pipe) thread both ends schedule 80 | Lasco | Lowes |
| 8 | 1" PVC 1120 SCH 40 PR 450 PSI | Silverline | Lowes |
| 9 | 3/4 " x 1 3/8" nipple (pipe) thread both ends schedule 80 | Lasco | Lowes |
| 10 | 2 7/8" dia. x 15/16" thick (approx. 1 3/4 lb.) steel w/ 3/4" pipe thread | none | Any metal fab. shop |
| | ***Can Ejector and Ramrod Handle Assembly (11-18)*** | | |
| 11 | 1/2" nylon plug | True Value | Lowes |
| 12 | 1/2" cpvc 100 psi, 180 deg | Genova | Lowes |
| 13 | 3/4" adapter female(3/4 ' thread female to 3/4" slip in female) | Lasco | Lowes |
| 14 | 1/2" coupling | Genova | Lowes |
| 15 | 3/4" PVC 1120 SDR-21 PR 200 PSI | Silverline | Lowes |
| 16 | 3/4" cap | Lasco | Lowes |
| 17 | 1/2" cpvc 100 psi, 180 deg | Genova | Lowes |
| 18 | 1/2" cpvc cap | Genova | Lowes |

FIG. 12

PORTABLE CAN CRUSHING AND PICKUP DEVICE

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER LISTING COMPACT DISC APPENDIX

Not Applicable

BACKGROUND OF THE INVENTION

1. Field of the Invention

This invention relates to mechanical devices used to grip and crush containers into flat and easily transported configurations, and more preferably to such a device that is also able to pick, carry, and eject the crushed container into a trash receptacle.

2. Description of Prior Art

Used beverage cans are typically picked up by those interested in removing trash from the environment or for the value of the can when presented to a recycler. Used beverage cans found laying on the ground usually are dirty or contain remnants of the original beverage, or other fluids, or other foreign objects. Picking up used beverage cans with unprotected hands exposes the individual picking up the can to fluids and debris left in and on the can. Picking up a can with a grasping device that does not expel remnant liquid, such as U.S. Pat. No. 5,370,432; U.S. Pat. No. 5,232,256, and U.S. Pat. No. 4,192,539 does not empty the can before picking it up and therefore exposes the operator to "spilt contents". Also repetitive bending over to pick up cans is a tiring effort and a strain on legs and back. Also picking up and collecting relatively small quantities of cans requires a large collection receptacle due to the volume of the cans. Therefore a device that is able to pick up and crush a can so that the collector is not exposed to strain or injury, exposed to contamination from debris, or made to haul large volume collection receptacles is desired. Prior efforts to solve this have resulted in devices that are complicated mechanically and prone to malfunction, that do not crush the can into the smallest practical volume, that do not effectively expel debris from the can, and that do not protect the operator of the device from the crushing operation or the debris being expelled.

Some examples are:

U.S. Pat. No. 6,481,346 B1, Compactor—Designed primarily for "a plastic beverage container"—Does not stand up can for crushing or reliably pickup can after crushing. Ejecting is stated as being the further extension of the plunger, which may expose user to injury. Requires user to insert can into device (thus touching) can. Also crushing is specified as a downward rotation, thus exposing the user to additional effort and potential for injury; U.S. Pat. No. 5,469,785, Combination Can Crushing And Retrieving Device—Foot operated, thus exposing foot to injury from the crushing operation and any debris expelled during crushing. Does not maximally crush can along longitudinal axis.

Doest not use a plunger; U.S. Pat. No. 5,370,432, Can Pickup Tool—Does not crush can; U.S. Pat. No. 5,232,256, Can Pickup Apparatus—Does not crush can; U.S. Pat. No. 5,176,072, Hand Held Aluminum Can Crusher—Requires user to pickup and insert can into device (thus touching) can. Is not operated from a standing position. Exposes operator's hand to injury during operation. Exposes operator to any debris expelled during crushing; U.S. Pat. No. 4,682,539, Can Crusher—Does not stand up can for crushing or pickup can after crushing. Exposes feet to injury from the crushing operation, due to their close proximity to the crushing operation and any debris expelled during crushing; U.S. Pat. No. 4,192,539, Stand-Up Trash Retrieving and Dumping Device—Does not crush can; U.S. Pat. No. 3,988,978, Beverage Can Folder—Foot operated thus exposing foot injury from the crushing operation and any debris expelled during crushing. Crushed can must be removed manually thus exposing user to injury and debris; and U.S. Pat. No. D320,801, Beverage Can Crusher—Does not stand up can for crushing or pickup can after crushing. Requires user to insert can into device, thus requiring touching of the can.

Despite many attempts to solve the problem, shortcomings persist. It is thus apparent that the need exists for a portable can crushing and pickup device that better addresses the foregoing needs.

BRIEF SUMMARY OF THE INVENTION

In accordance with the present invention, there is disclosed a portable can crushing and pickup device and method of use, with the apparatus having a circular or tubular housing with a rectangular opening in its lower side wall, a weighted plunger or slide hammer contained therein, a can holding device at the base of the housing opposite the rectangular opening, and an ejecting rod that runs inside the plunger handle through to the end of the weight.

A self contained can crusher and retrieving device that stands cans up and holds cans upright so that a plunger can be forced down, or if the plunger is spring loaded the spring released, to crush the can into the smallest desired volume along its longitudinal axis. The crushing operation is shielded from the operator by the housing and any debris in the can is forced out and onto the ground. Also the operator is protected from the crushing operation since the weight stops short of contact with the ground. Thus, accidental insertion of an appendage, such as foot or toe, into the crushing zone will not result in forceful contact of the weight with the appendage. The can is then held in place to be picked up by the device and subsequently ejected into a receptacle via the ejector rod, thus avoiding "hand" contact with the can.

It is accordingly the object of this invention to provide an improved stand-up device for retrieving an object from a generally flat surface and thereafter dumping the same.

Another object of the invention is to provide an improved stand-up device for retrieving objects of different sizes from a generally flat surface and crushing the objects, and thereafter dumping them. The above-mentioned and other features and objects of this invention and the manner of attaining them will become more apparent, and the invention itself will be best understood by reference to the following description of the embodiment of the invention taken in conjunction with the accompanying drawings.

BRIEF DESCRIPTION OF THE DRAWINGS

In order for the invention to more clearly understood the following drawings are presented.

FIG. 12 is a listing of individual parts that can be purchased at a Hardware store if the invention is to be made of common PVC pipe and fittings.

DETAILED DESCRIPTION OF THE INVENTION

Description of the Preferred Embodiment

Figure 1:
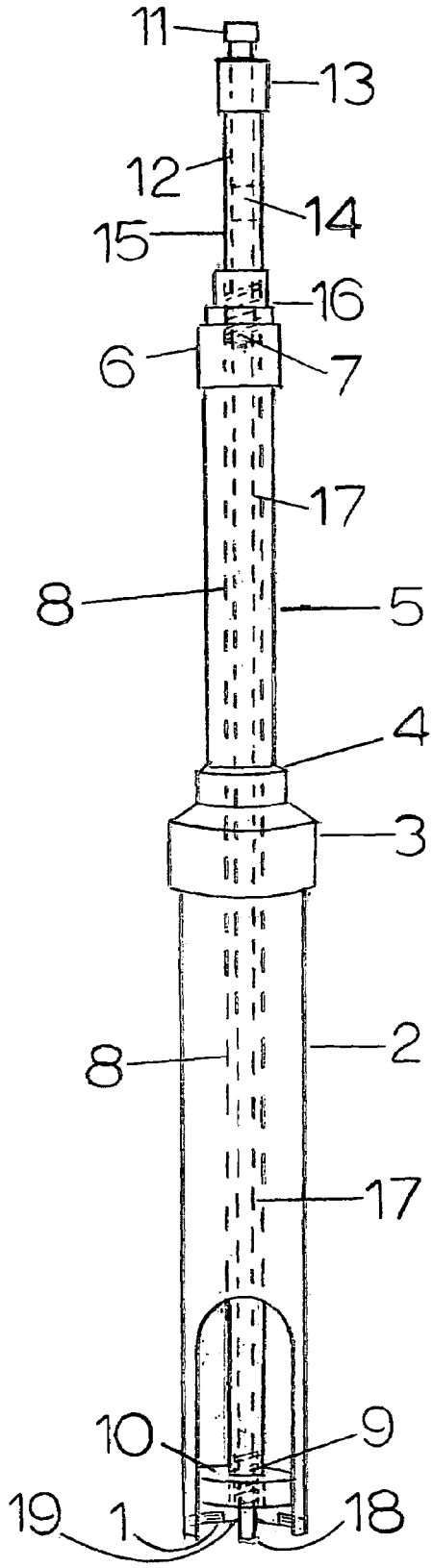
FIG. 1 is a sketch of the device.

In describing the preferred embodiment of the invention shown in the drawings and figures, specific terminology will be resorted to for the sake of clarity. However, it is not intended that the invention be limited to the specific term so selected and it is to be understood that each specific term includes all technical equivalents which operate in a similar manner to accomplish a similar purpose.

Figure 2:
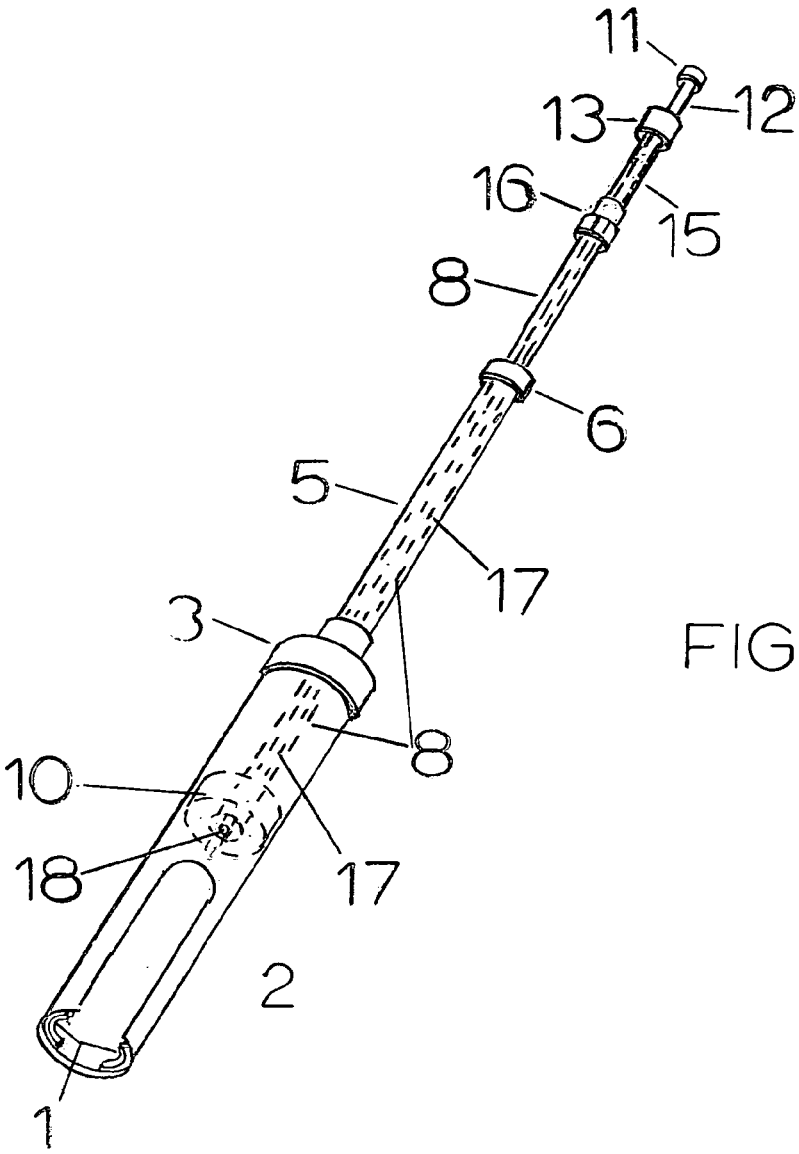
FIG. 2 is an isometric sketch of the device.
Figure 3:
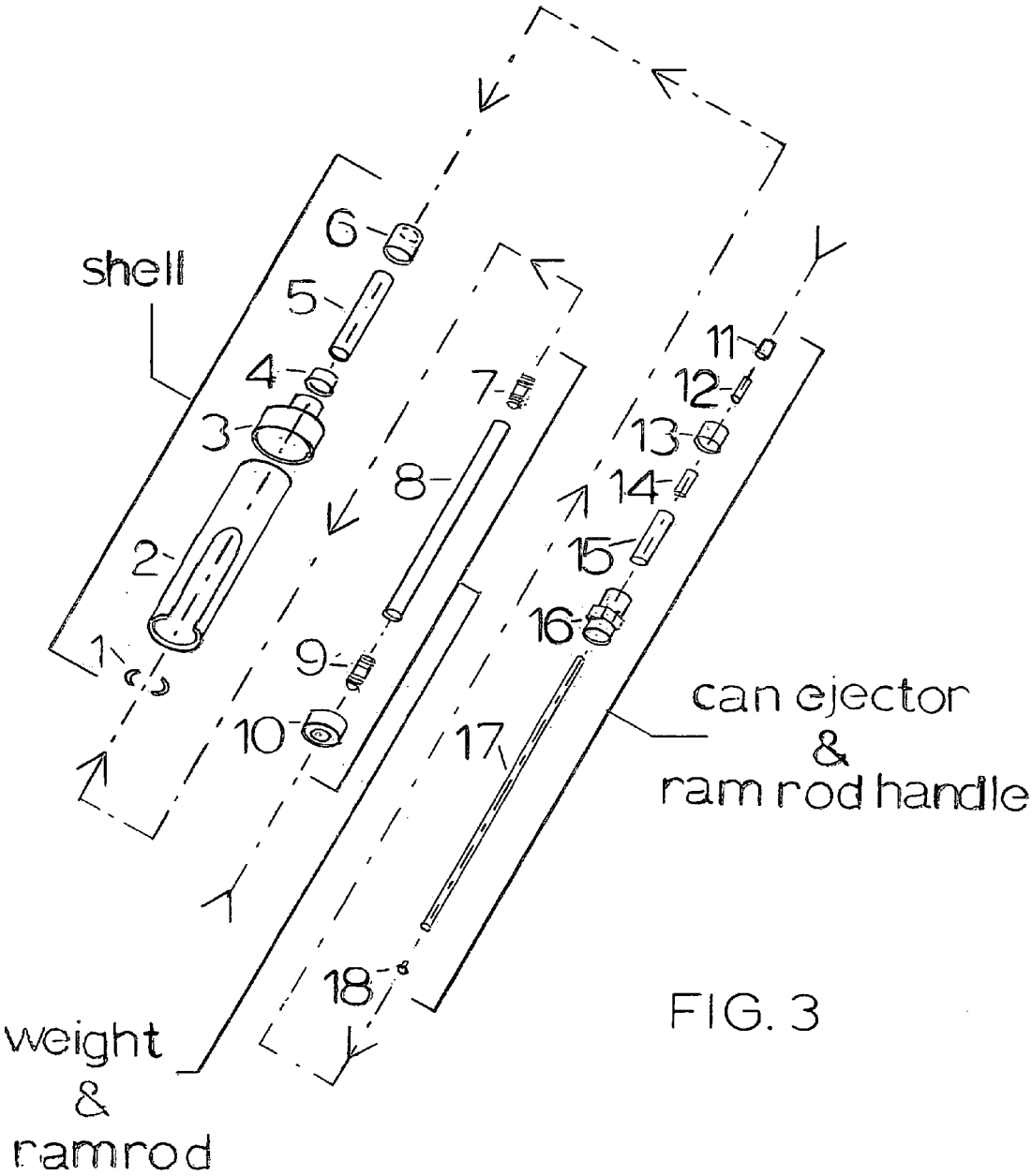
FIG. 3 is an exploded sketch of the device showing the individual parts comprising the device.
Figures 4A, 4B, 4C:
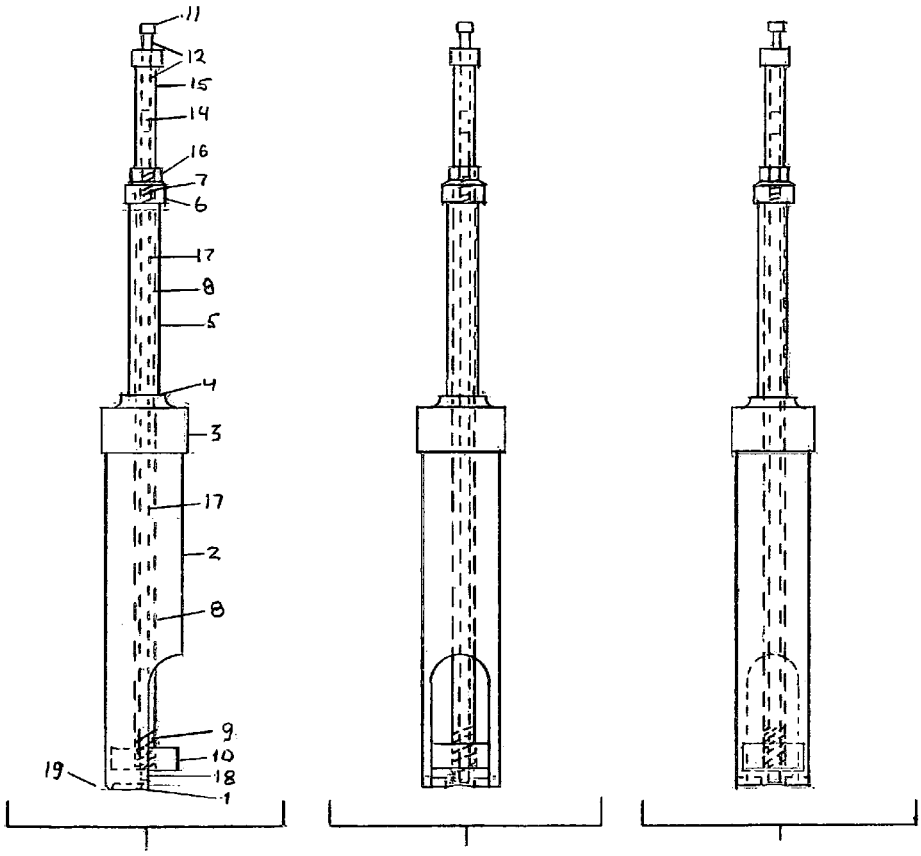
FIG. 4A, 4B, 4C is side view, front view, rear view sketches of the device made in accordance with the invention.
Figure 5:
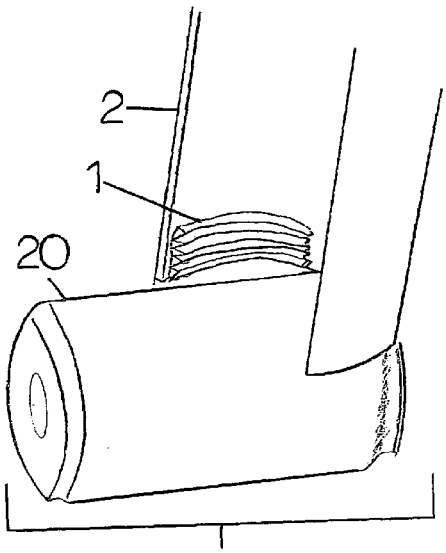
FIG. 5 is a view of the device positioned on the necked down portion of an aluminum drinking can.
Figure 6:
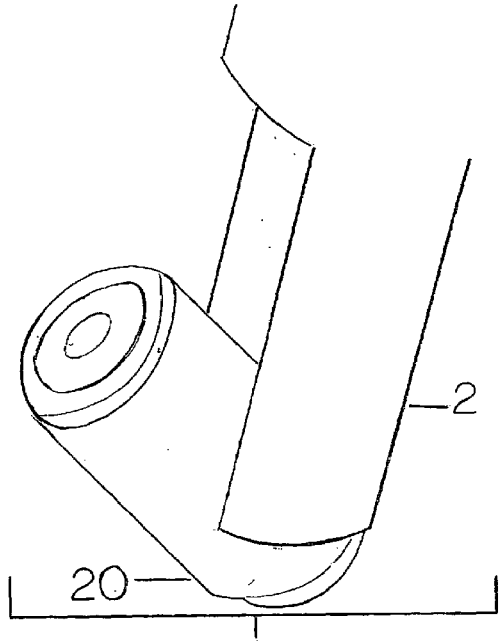
FIG. 6 is view of the device standing or snapping up a can into the device.
Figure 7:
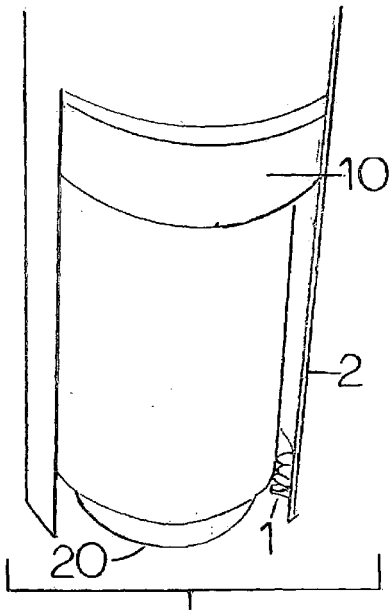
FIG. 7 is a view of a can in the device ready for the crushing operation.
Figure 8:
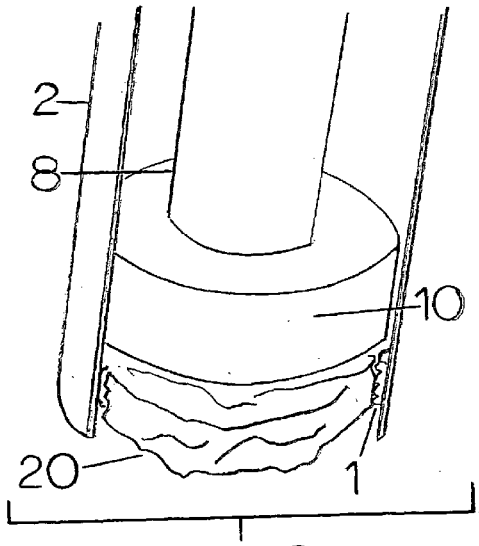
FIG. 8 is a view of a crushed can in the device.
Figure 9:
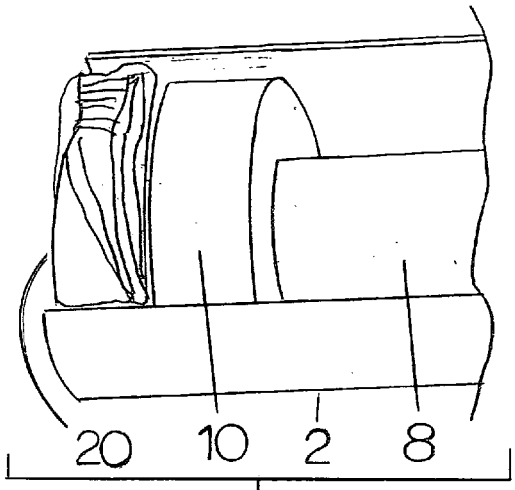
FIG. 9 is a view of a crushed can held in the device after raising the device.
Figure 10:
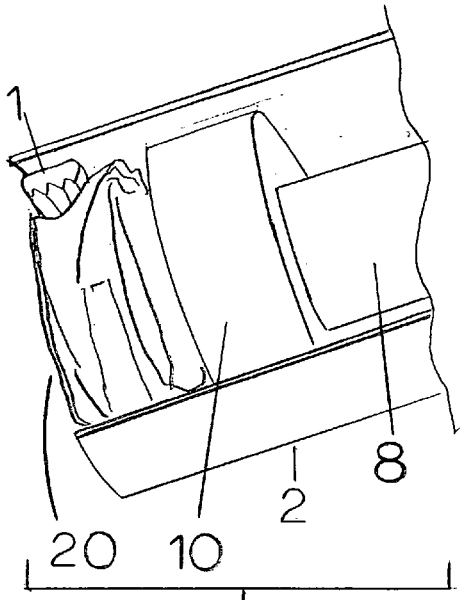
FIG. 10 is a view of a crushed can held in the device where the device is positioned to eject the can into a receptacle.
Figure 11:
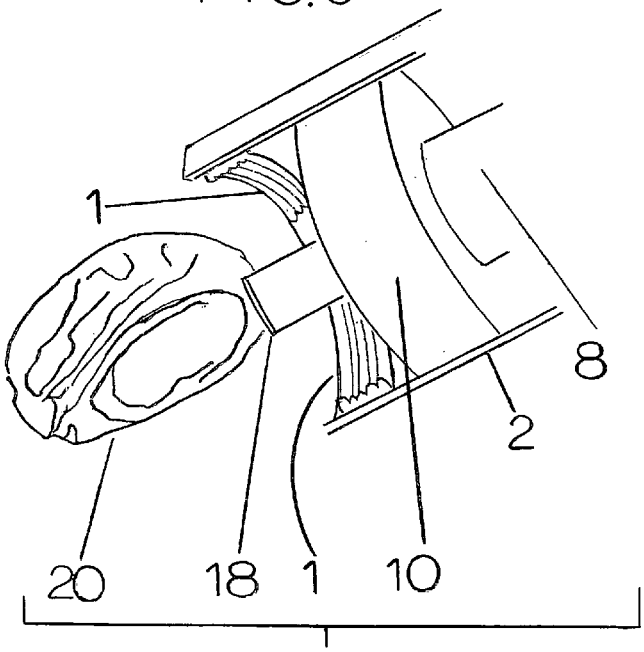
FIG. 11 is a view of a crushed can being ejected from the device.

Referring now to figures of the drawings, the improved stand-up device for retrieving cans from a flat surface, crushing such can, and thereafter dumping the can into a receptacle, or the like, is depicted in FIG. 1. FIG. 2 is an isometric sketch of the device. FIG. 3 is an exploded sketch of the device showing the individual parts comprising the device. The individual parts comprising the device are listed in FIG. 12, and they can be purchased, if the device is assembled of common PVC pipe and fittings, at a local hardware store. In a more general sense these parts are: (1) Retention Material to hold a can in Housing (2), Housing Reducer (3), Reducer (4) (used when constructing the device from standard PVC fittings), Plunger Handle Housing (5), Plunger Handle Housing Cap (6), Male Threaded Connector from Ramrod to Ramrod Handle Assembly (7), Ramrod (8), Male Threaded Connector from Ramrod to Weight (9), Weight (10), Can Ejector Plunger Rod Plug (11), Can Ejector Plunger Rod (12), Female Threaded Connector from Handle Assembly to Ramrod (13), Handle (15), Coupling (14), from Can Ejector Plunger Rod (12) to Can Ejector Rod Extension (17), Handle Cap (16), Can Ejector Plunger Rod Extension Cap (18). Items 1 through 6 depict the Shell, Items 7 through 10 depict the Weight & Ramrod, Items 11 through 18 depict the Can Ejector and Ramrod Handle. The Weight and Ramrod slide within the shell and the Can Ejector slides within the Ramrod with the Handle Assembly being connected to the Ramrod. FIG. 4 is comprised of standard views of objects, FIG. 4A is a side view of the device, FIG. 4B is a front view of the device, FIG. 4C is a rear view of the device. FIGS. 5 through 11 show the sequence of operation of the device. FIG. 5 is a depiction of the slight concave indent (19) on the lower portion of the shell (2) being placed on the necked down portion of a aluminum can laying on its' side. FIG. 6 depicts the aluminum can being snapped into an upright position by applying downward pressure on the device. FIG. 7 depicts the aluminum can (20) secure in the lower portion of the shell (2) after being snapped upright; the weight (10) is positioned over the can. FIG. 8 depicts the aluminum can (20) crushed by a downward stroke of the weight (10) attached to the ramrod (8). FIG. 9 shows the lower portion of the device, shell (2), raised to a horizontal position, holding the crushed aluminum can (20). FIG. 10 shows the lower portion of the device, shell (2), positioned at a slight downward angle, being held in place by the retention material (1), just prior to ejecting the crushed aluminum can (20) into a receptacle. FIG. 9 shows the crushed aluminum can (20) being ejected from the device by the ejector rod (17).

While there have been described above the principles of this invention in connection with the specific apparatus, it is to be clearly understood that this description is made only by way of example and not as a limitation to the scope of the invention. Further, there are possible variations of the handle configuration such as shovel handle grip, pistol grip, also the addition of mechanical (e.g. spring loading) or electrical (e.g. magnetic field induction) power to provide an assist to the plunger compaction, and such modifications would be readily appreciated as being able to operationally be installed as parts of the invention by one of ordinary skill in the art.

I claim:

1. A portable can crushing and pickup device comprising:

a tubular housing having an open bottom and a sidewall on a first end;

a rectangular opening formed in a bottom portion of the sidewall for allowing an aluminum can in an upright position to pass through;

a knife-edged concave indent formed on a bottom edge of the housing, the knife-edged concave indent is positioned opposite to the rectangular opening, the knife-edged concave indent generally conforms to an arch section of a necked down portion of an aluminum can and may be lined with a friction material;

a piece of rubber is positioned inside the housing and adjacent to the bottom edge of the housing, the piece of rubber is positioned on either side of the rectangular opening and running between the rectangular opening and the knife-edged concave indent;

a sliding weight and a ram rod is movable inside the housing, the ram rod having one end attached to the sliding weight and an opposite end attached to a handle, the opposite end of the ram rod passes through a second end of the housing, the handle having a stop configured to stop the sliding weight just short of reaching the piece of rubber; and an ejector rod passes through an interior of the handle, the ram rod, and the weight, the ejector rod having one end positioned outside and on top of the handle for ejecting a crushed aluminum can from the housing, wherein a diameter of the housing at the first end is larger than a diameter of the housing at the second end.

* * * * *